US009163469B2

(12) United States Patent
Broussard et al.

(10) Patent No.: US 9,163,469 B2
(45) Date of Patent: Oct. 20, 2015

(54) ONE TRIP PACKER PLUG DEBRIS MILLING AND REMOVAL METHOD

(71) Applicant: Baker Hughes Incorporated, Houston, TX (US)

(72) Inventors: Lee J. Broussard, Schriever, LA (US); Jonathan F. Nelson, Houma, LA (US)

(73) Assignee: Baker Hughes Incorporated, Houston, TX (US)

( * ) Notice: Subject to any disclaimer, the term of this patent is extended or adjusted under 35 U.S.C. 154(b) by 383 days.

(21) Appl. No.: 13/662,015

(22) Filed: Oct. 26, 2012

(65) Prior Publication Data

US 2014/0116705 A1 May 1, 2014

(51) Int. Cl.

| | |
|---|---|
| ***E21B 31/16*** | (2006.01) |
| ***E21B 37/00*** | (2006.01) |
| *E21B 31/00* | (2006.01) |

(52) U.S. Cl.

CPC ..... *E21B 31/16* (2013.01); *E21B 37/00* (2013.01); *E21B 31/002* (2013.01)

(58) Field of Classification Search

CPC ..... E21B 21/00; E21B 23/03; E21B 23/004; E21B 23/00; E21B 29/00; E21B 31/16; E21B 31/03; E21B 31/12

See application file for complete search history.

(56) References Cited

U.S. PATENT DOCUMENTS

| | | | | |
|---|---|---|---|---|
| 4,436,155 | A | 3/1984 | Brieger | |
| 4,616,721 | A * | 10/1986 | Furse | 294/86.18 |
| 5,123,489 | A * | 6/1992 | Davis et al. | 166/377 |
| 5,881,816 | A * | 3/1999 | Wright | 166/376 |
| 6,681,858 | B2 | 1/2004 | Streater | |
| 7,472,745 | B2 | 1/2009 | Lynde et al. | |
| 2003/0205377 | A1 | 11/2003 | Streater | |
| 2010/0181789 | A1 | 7/2010 | Davis et al. | |
| 2010/0288485 | A1 * | 11/2010 | Blair | 166/99 |
| 2011/0253376 | A1 * | 10/2011 | Krpec | 166/311 |

FOREIGN PATENT DOCUMENTS

| | | |
|---|---|---|
| WO | 9846855 | 10/1998 |

* cited by examiner

*Primary Examiner* — Robert E Fuller
*Assistant Examiner* — Christopher Sebesta
(74) *Attorney, Agent, or Firm* — Steve Rosenblatt

(57) ABSTRACT

A combination tool is delivered to compacted debris above a packer whose plug is to be removed. The shoe or mill is on the lower end of an outer bushing and the grapple or overshot is held within the bushing but away from the shoe so that the shoe can advance into the debris as reverse circulation takes the cuttings up through a mandrel to a debris removal tool. When the shoe lands on the packer the surface personnel can see it on the weight indicator. Weight is then set down to overcome a resisting force of a breakable member such as a shear pin or a spring or both so that the grapple advances to engage the packer plug. Advancing the mandrel relative to the bushing with the shoe at its lower end also releases a torque lug that previously allowed tandem rotation of the mandrel with the bushing.

24 Claims, 2 Drawing Sheets

ONE TRIP PACKER PLUG DEBRIS MILLING AND REMOVAL METHOD

FIELD OF THE INVENTION

The field of the invention is methods of milling difficult debris accumulated above a packer plug from completion activities above the packer and more particularly engaging a packer plug after debris removal and removing the plug in a single trip.

BACKGROUND OF THE INVENTION

There are occasions where packers or other tools need to be milled out and yet portions of the tool need to be retained from falling in the hole once enough milling has gone on to release the packer or other tool. In the past such tools have been advanced into the packer bore or an extension to such a packer bore and included a grapple that was forced into the bore. If the packer let go the grapple was cammed outwardly by a series of inclined surfaces with such camming being triggered by the released weight of the remaining packer. The mandrel could be picked up and turned to the right to engage ratchet teeth so that a left hand thread is engaged to allow rotation of the grapple gripping member with respect to the packer bore for a release, if necessary. One such prior design shown in Streater U.S. Pat. No. 6,681,858.

Streater uses a longitudinally split cylindrically shaped grapple member 106 that rides in a wedge 104. Grapple 106 has a groove 126 through which extends a tab 110. The groove and the tab are in the middle of the cylinder shape with the tab not extending as far out of the groove so that it stays clear of the packer bore. The problem with this design is during an attempt to release the packer by engaging teeth 124 and 134 while rotating to the right. As the grapple 106 which has an exterior left hand thread starts to come out of the packer bore while having torque transmitted into it through tab 110, some of the grapple 106 is still in the packer bore while the tab 110 transmits torque through slot 126 to the remainder of the cylindrically shaped grapple member now free of the packer bore and less resistant to applied torque. What can happen is that a shear failure can occur at the grapple which, in turn, results in getting the whole tool stuck with the part milled out packer.

US Publication 2010/0181789 provided a grapple for a downhole tool being milled out where the grapple members are better supported in a removal attempt when turning to the right. In a preferred embodiment fingers with exterior wickers that form a left hand thread extend from a ring. The wedge assembly has a series of torque fingers that preferably span the length of the grapple wickers and preferable are disposed on opposed sides of the grapple fingers. The ramp adds force to rotate the grapple when it is turned to the right. A reverse circulation pattern is used with the mill to remove and capture cuttings through the mill body in conjunction with the grapple device. A similar device is described in WO 1998/46855.

These devices were used to mill a packer free and keep from losing it down the hole so that it could be brought up to the surface. More recently wells have been drilled deeper ranging to depths of 20,000 feet or more. These wells typically have isolation packers with removable plugs that need to be pulled to expose the zone below for additional completion or production. The plugs are in place in the set packers to provide zone isolation for completion procedures above. During such procedures such as fracturing debris that accumulates above the packer plug has to be removed. Due to the depths involved and the types of formations that are penetrated, the accumulated material compacts into a rather hard barrier that has to be removed.

In the past with wells that are less deep, the procedure was to make a first trip to remove debris with moving fluid and a debris removal tool and then come back with a grip tool to grab the packer plug in a second trip. With wells getting deeper the cost of a second trip became significant. Also with the deeper wells the debris was so hard and compacted that mere circulation would not suffice to get the debris dislodged sufficiently to expose the packer plug.

Debris removal tools that create reverse flow through milling shoes are illustrated in U.S. Pat. No. 7,472,745.

What was needed and provided by the present invention is a combination tool that includes a milling shoe that uses pipe rotation to grind up the debris so that a reverse circulation system associated with the shoe and a debris removal tool can capture the milled debris until the shoe lands on the packer as noted on the weight indicator at the surface. Once pipe rotation is stopped, the grapple is advanced with an inner mandrel until contact with the plug is made. The assembly that includes the mandrel with the grapple retaining the plug and the surrounding bushing with the shoe or mill at its lower end can be brought up with the mandrel. The grapple or overshot is held retracted and torsionally locked during debris milling and is advanced after the shoe lands on the packer with set down weight that overcomes a shear device or spring or both. These and other aspects of the present invention will be more readily apparent to those skilled in the art from a review of the detailed description and the associated drawings while recognizing that the full scope of the invention is to be found in the appended claims.

SUMMARY OF THE INVENTION

A combination tool is delivered to compacted debris above a packer whose plug is to be removed. The shoe or mill is on the lower end of an outer bushing and the grapple or overshot is held within the bushing but away from the shoe so that the shoe can advance into the debris as reverse circulation takes the cuttings up through a mandrel to a debris removal tool. When the shoe lands on the packer the surface personnel can see it on the weight indicator. Weight is then set down to overcome a resisting force of a breakable member such as a shear pin or a spring or both so that the grapple advances to engage the packer plug. Advancing the mandrel relative to the bushing with the shoe at its lower end also releases a torque lug that previously allowed tandem rotation of the mandrel with the bushing.

DETAILED DESCRIPTION OF THE PREFERRED EMBODIMENT

Figure 1:
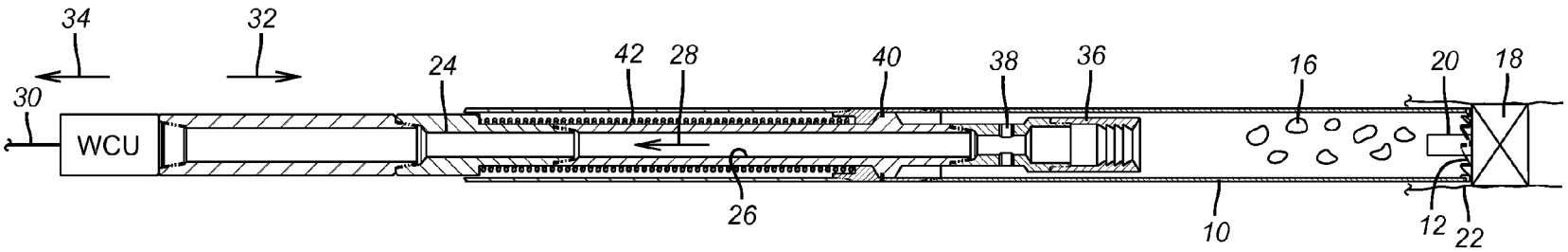
FIG. 1 is a section view of assembly when run in and milling has progressed to the packer.

FIG. 1 illustrates a bushing 10 that has a shoe 12 at its lower end. An overshot 14 is retained in a raised position from the shoe 12 for milling out debris 16 that has accumulated above the packer 18 having a removable plug 20 on its top side.

Bushing 12 is run into wellbore 22 on a mandrel 24. Mandrel 24 can be selectively locked to the bushing 12 by having a Kelly section 26 that meshes with a similar profile on the bushing 12 so that the mandrel 24 and the bushing 12 turn together until weight is set down on the mandrel 24 with the shoe 12 landed on the packer 18. Debris 16 is carried in the direction of arrow 28 to a wellbore cleanup unit WCU such as is described in U.S. Pat. No. 7,472,745. The string 30 delivers clean motive fluid that creates a drawing force for debris laden fluid in the direction of arrow 28 toward screens that are not shown in the WCU. The WCU has two exhaust streams after passing through screens and leaving debris 16 being retained in the WCU. The stream 32 goes downhole to the shoe to move more debris 16 into the shoe with reverse circulation. Arrow 34 represents flow back up to the surface that is eventually pumped back down string 30.

During milling of debris 16 the shoe descends through the debris 16 until it makes contact with the top of the packer 18. The shoe does not mill the packer 18. When the shoe lands on the packer 18 surface personnel see a drop in the weight indicator as a signal that the packer 18 has been reached by the shoe 12 and that milling and rotation can stop.

The overshot 36 has been held higher than the shoe 12 during milling of debris 16. This allows the bushing 10 to descend without concern that the overshot 36 will hit any part of the packer 18 before the shoe 12 lands on the packer 18.

Figure 2:
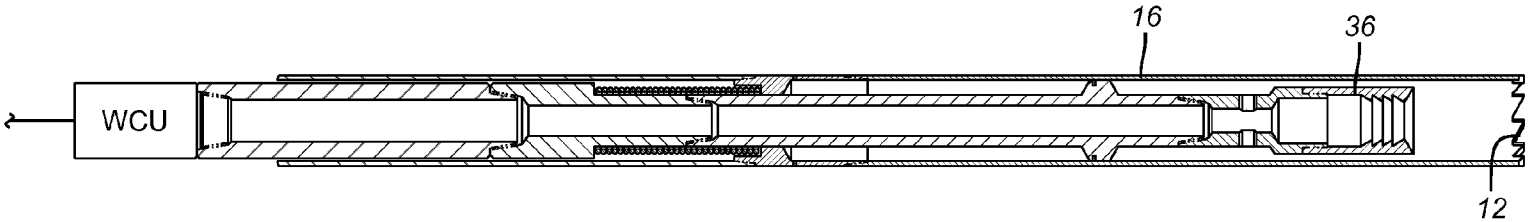
FIG. 2 is the view of FIG. 1 with the milling done and weight set down on the mandrel to advance a grapple to grip a packer pug.
Figure 3:
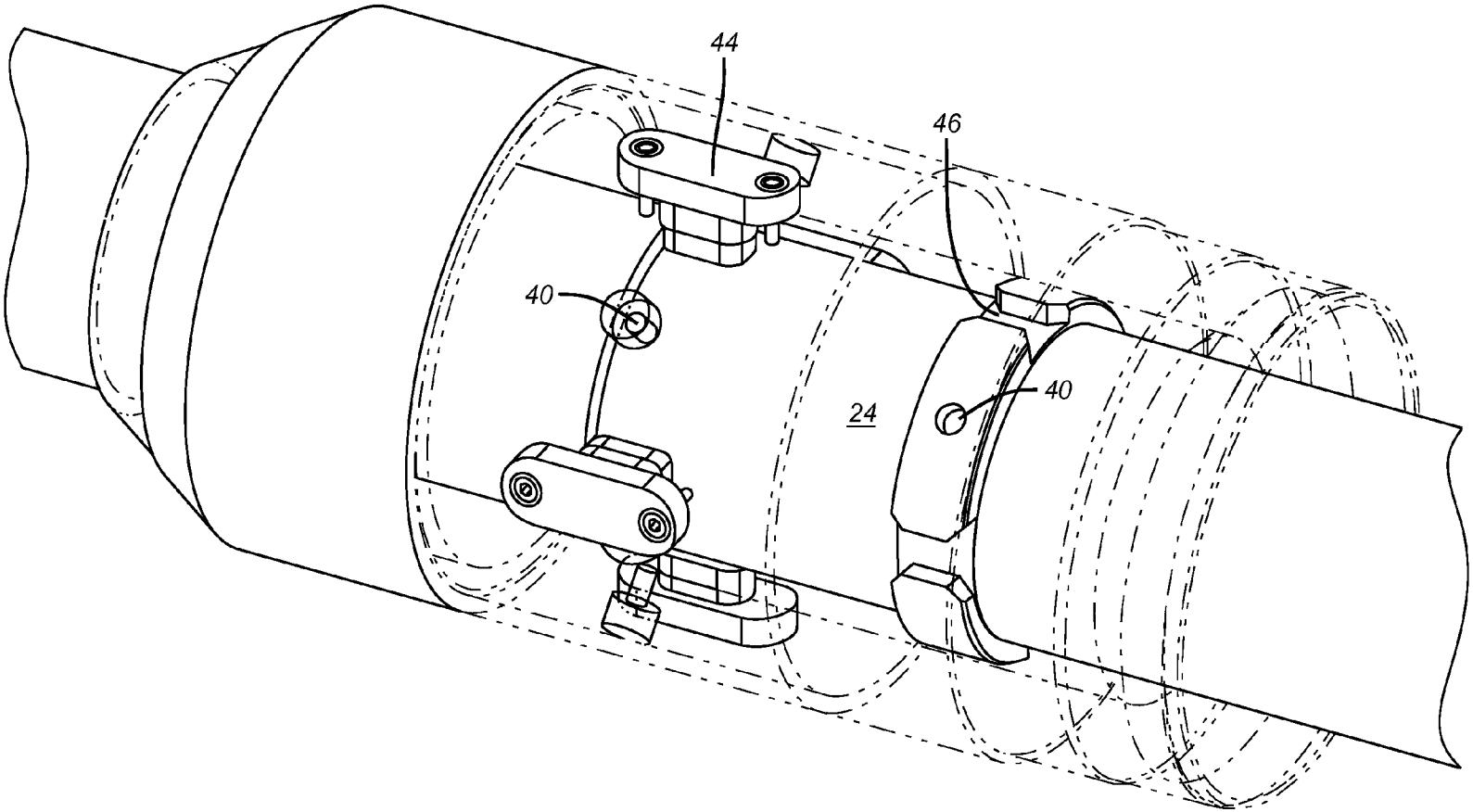
FIG. 3 is a see through perspective view locating the shear pins and the releasable torque lug shown in the shifted/post shear position.

With the FIG. 1 position reached the method calls for lowering the overshot 36 so that the packer plug 20 is engaged for removal. There are ports 38 for circulation through mandrel 24 after the plug 20 is gripped by the overshot 36 to assist in the removal of the bushing 10. Getting to the FIG. 2 position can be accomplished by breaking shear pins 40 and overcoming optional spring 42, if used. Alternates to spring 42 can be a compressible gas in a variable volume chamber or a stack of Belleville washers. Setting down weight is made possible by the fact that the shoe 12 is landed on the packer 18. Setting down weight also releases a rotational lock between the mandrel 24 and the bushing 10. After the shear pins 40 are broken an open ended slot 46, see FIG. 3, on the mandrel 24 is moved away from lug 44 on the bushing 10. The slot on the mandrel 24 is just forced down with the mandrel 24 leaving the rotational locking lug 44 on the bushing 10 behind. There is no need to rotate and mill further at this point. However on picking up the lug 44 is guided back into the slot by adjacent end tapers that are not shown. An option for rotation still exists if needed to release the plug from the overshot 36. Moving the mandrel 24 out of the wellbore brings out with it the shoe 10.

Those skilled in the art will appreciate that the method allows milling difficult debris and collecting the debris locally as the shoe advances toward the packer with the plug to be removed. In the same trip the overshot is present to grab the plug. Milling continues with reverse circulation created by flow down the string through the WCU so that the debris can be held in that unit as the fluid continues moving. When the weight indicator at the surface signals that the packer has been reached the rotation stops and setting down weight advances the overshot to grasp the packer plug. The relative movement from setting down weight will defeat the rotational lock until the plug with the bottom hole assembly are picked up. At that point a lug and slot get back together for rotation if there is some need to release the plug as it is being removed.

The above description is illustrative of the preferred embodiment and many modifications may be made by those skilled in the art without departing from the invention whose scope is to be determined from the literal and equivalent scope of the claims below:

We claim:

1. A one trip method for debris removal adjacent a packer plug and retrieval of the plug comprising:

running in an assembly of a shoe mounted to a mandrel, a fishing tool and a wellbore cleanup tool to debris located above a packer plug;

milling the debris with said shoe rotationally locked to said mandrel;

releasing said rotational locking after said milling;

capturing the packer plug after said releasing;

removing the packer plug with said assembly;

using a single trip for said running in and removing.

2. The method of claim 1, comprising:

advancing the fishing tool toward said shoe or plug after said milling.

3. The method of claim 1, comprising:

retaining said fishing tool spaced apart from said shoe during said milling with a breakable member.

4. The method of claim 1, comprising:

retaining said fishing tool spaced apart from said shoe during said milling with a biasing member.

5. The method of claim 4, comprising:

using at least one of a spring, a compressible gas in a variable volume and a stack of Belleville washers for said retaining said fishing tool during said milling.

6. The method of claim 1, comprising:

locating said fishing tool on said a mandrel which mandrel extends through a surrounding bushing;

locating said shoe on a lower end of said bushing.

7. The method of claim 6, comprising:

selectively rotationally locking said bushing and said mandrel;

driving said shoe with rotation of said mandrel when said mandrel is rotationally locked to said bushing.

8. The method of claim 6, comprising:

using a lug on one of said bushing and mandrel to selectively engage an axial slot on the other of said bushing and mandrel for rotational locking therebetween.

9. The method of claim 1, comprising:

milling said debris until the shoe reaches the packer;

landing the shoe on the packer as a signal to stop shoe rotation.

10. The method of claim 1, comprising:

capturing milled debris above said fishing tool in the wellbore cleanup tool.

11. The method of claim 1, comprising:

flowing milled debris through the fishing tool;

capturing milled debris in the wellbore cleanup tool above the fishing tool.

12. The method of claim 8, comprising:

making one end of said slot open;

moving said lug from said slot when setting down weight on said mandrel.

13. The method of claim 12, comprising:

returning said lug to said slot when picking up the mandrel with the bushing with the packer plug retained.

14. The method of claim 6, comprising:

providing at least one reverse circulation port in the mandrel;

flowing fluid from said mandrel when picking up the mandrel and removing the packer plug.

15. The method of claim 2, comprising:

retaining said fishing tool spaced apart from said shoe during said milling with a breakable member.

16. The method of claim 15, comprising:

retaining said fishing tool spaced apart from said shoe during said milling with a biasing member.

17. The method of claim 16, comprising:

locating said fishing tool on said mandrel which mandrel extends through a surrounding bushing;

locating said shoe on a lower end of said bushing.

18. The method of claim 17, comprising:

selectively rotationally locking said bushing and said mandrel;

driving said shoe with rotation of said mandrel when said mandrel is rotationally locked to said bushing.

19. The method of claim 18, comprising:

using a lug on one of said bushing and mandrel to selectively engage an axial slot on the other of said bushing and mandrel for rotational locking therebetween.

20. The method of claim 19, comprising:

milling said debris until the shoe reaches the packer;

landing the shoe on the packer as a signal to stop shoe rotation.

21. The method of claim 20, comprising:

capturing milled debris above said fishing tool in the wellbore cleanup tool.

22. The method of claim 21, comprising:

flowing milled debris through the fishing tool;

capturing milled debris in the wellbore cleanup tool above the fishing tool.

23. The method of claim 22, comprising:

making one end of said slot open;

moving said lug from said slot when setting down weight on said mandrel.

24. The method of claim 10, comprising:

using reverse flow to capture the milled debris.

* * * * *